United States Patent [19]

Godin et al.

[11] 4,286,450

[45] Sep. 1, 1981

[54] APPARATUS FOR MANUFACTURING CORRUGATED TUBES

[76] Inventors: Eduard M. Godin, ulitsa Begovaya, 22, korpus 3, kv. 212; Vladimir A. Anoshko, ulitsa Shosseinaya, 58, korpus 1, kv. 84; Anatoly N. Gavrilov, Kutuzovsky prospekt, 43, kv. 118, all of Moscow; Almas F. Akhmerov, ulitsa Kosmonavtov, 2, kv. 19, Kazan; Garik E. Zverkov, ulitsa Oktyabrskoi revoljutsii, 24, kv. 40; Valentin P. Semenov, prospekt Stroitelei, 8, kv. 40, both of Smolensk; Vladimir V. Grachev, ulitsa Bobruiskaya, 22, kv. 82, Moscow; Valentin M. Chepurin, ulitsa Starodemidovskaya, 8b, kv. 28, Smolensk; Viktor Y. Mikhailov, 4 mikroraion, 29, kv. 226, Angarsk; Sergei I. Rybnikov, ulitsa Supruna, 3/5, kv. 3, Moscow, all of U.S.S.R.

[21] Appl. No.: 105,857

[22] Filed: Dec. 20, 1979

[30] Foreign Application Priority Data

Feb. 3, 1978 [SU] U.S.S.R. ..... 2570051

[51] Int. Cl.[3] ..... B21D 15/06

[52] U.S. Cl. ..... 72/59; 72/11

[58] Field of Search ..... 72/58, 59, 61, 62, 11; 29/421 R

[56] References Cited

U.S. PATENT DOCUMENTS

| | | | |
|---|---|---|---|
| 2,610,667 | 9/1952 | Puster | 72/59 X |
| 2,796,109 | 6/1957 | Wood | 72/59 |
| 3,083,754 | 4/1963 | De Mess | 72/59 |
| 3,099,311 | 7/1963 | Van Leer et al. | 72/59 |
| 3,704,983 | 12/1972 | Tellot | 72/59 |

*Primary Examiner*—Leon Gilden

*Attorney, Agent, or Firm*—Lackenbach, Lilling & Siegel

[57] ABSTRACT

An apparatus for manufacturing corrugated tubes comprises a unit with a hydraulic drive for clamping and sealing the tubular billet, and a device for axial compression of said tubular billet communicating with a compressed gas source. The apparatus also comprises tools installed symmetrically with relation to the direction of compression with a provision for reciprocating across said direction for at least partial encompassing of the tubular billet. The apparatus comprises a device with a pressure regulator for delivering pressurized liquid from a liquid source into the space of the tubular billet for forming the corrugated tube. The apparatus further comprises a device for programmed pressure control inside the tubular billet whose inlet is connected to the hydraulic drive of the clamping and sealing unit and its outlet, to the inside space of the tubular billet, and a device for programmed control of axial compression force whose inlet is connected to the compressed gas source and the outlet, to the axial compression device for displacing the movable member thereof, both of said devices being in operational communication with each other for synchronous changes of axial compression force and pressure inside the tubular billet.

7 Claims, 3 Drawing Figures

APPARATUS FOR MANUFACTURING CORRUGATED TUBES

The present invention relates to mechanical working of materials and more particularly it relates to an apparatus for manufacturing corrugated tubes.

The apparatus of the present invention is used most effectively for manufacturing thin-walled hollow products with a corrugated surface, such as bellows.

The invention can also be utilized for manufacturing a tubular billet into thin-walled products with any shape of the surface determined by the type of the tool encompassing the tubular billet.

BACKGROUND OF THE INVENTION

Known in the prior art is an apparatus for manufacturing corrugated tubes comprising tools, a unit for clamping and sealing the tubular billet, a forming liquid delivery unit and a unit for creating an axial compression force. The apparatus incorporates a means for controlling the pressure of the forming liquid and a means for controlling the amount of the forming liquid to suit the axial compression force (see U.S. Pat. No. 2,919,740).

However, said control of the pressure of the forming liquid and of the axial compression force causes a biaxial stressed state in the material of the tubular billet which results, as a rule in a, considerable thinning out of the corrugation apices and, as a consequence, in low operating characteristics of the product.

Also known in the prior art is an apparatus for manufacturing corrugated tubes comprising tools, a unit for clamping and sealing the tubular billet, a unit delivering the forming liquid and an axial compression unit. In this apparatus, the pressure of the forming liquid is raised until the wall of the tubular billet is bent to a certain degree under the effect of the pressure of the forming liquid delivered into the tubular billet. Then the tubular billet is subjected to an axial compression load while the pressure of the forming liquid is kept constant to the point when the corrugations are fully formed see U.K. Pat. No. 641,389, granted in 1950).

However, the material of the tubular billet in the prior art apparatus is subjected to biaxial extension which usually adversely affects the quality of the finished product.

Known in the prior art is an apparatus for manufacturing corrugated tubes comprising a bed which mounts a unit with a hydraulic drive for clamping and sealing a tubular billet, a device for axial compression of the tubular billet, holders with appropriate tools, and a device for delivering pressurized liquid into the tubular billet.

The clamping and sealing unit is designed to orient and clamp the tubular billet relative to the tools and, additionally, to prevent the forming liquid from leaking out of the tubular billet, said liquid being delivered under pressure into the tubular billet.

The clamping and sealing unit is fixed on the bed and comprises two coaxial movable members. These members are mounted at a certain distance from each other for locating the tubular billet between their ends. The members are installed in bodies rigidly fixed on the bed and are capable of moving relative to the bodies towards each other for clamping and sealing the tubular billet. In the course of tube forming the ends of the members fit tightly against the ends of the tubular billet, reliably sealing the inside space of said billet.

The axial compression device is intended to produce a compressing force applied axially to the tubular billet. Inasmuch as the length of the tubular billet diminishes in the process of forming, the device ensures convergence of the movable members of the clamping and sealing unit for maintaining a constant contact between the ends of the members and the tubular billet and ensures hermetically sealing of the billet space which is supplied with the forming liquid.

The axial compression device consists of a bed-mounted hydraulic cylinder whose rod is rigidly connected with the frame which has tapered side surfaces. These surfaces interact with the ends of two-arm levers arranged symmetrically to the axis of the hydraulic cylinder. The lever axles are fixed on the bed of the apparatus. The other ends of the levers are kinematically coupled with the movable members of the clamping and sealing unit. During the movement of the hydraulic cylinder piston, the piston rod moves the frame with the tapered side surfaces. These surfaces press the ends of the two-arm levers. The levers turn about their axes, the other ends of the levers press the members towards each other and thus clamp the tubular billet located between the members.

The tools installed on the holders are intended to fit around the tubular billet so that in the course of forming the corrugations by the pressure fed into the billet, the latter would take the shape corresponding to the shape of the tool.

The holders with tools are mounted with a provision for moving relative to each other in a plane which is perpendicular to the axis of the tubular billet. The tools are moved by a hydraulic cylinder whose rod is connected with the holder and its body, with the bed of the apparatus. After the tubular billet has been clamped between the members, the holders with tools are actuated by the pressure supplied from the cylinder, and the tools encompass the tubular billet.

The device for delivering pressurized liquid is intended to supply this liquid into the tubular billet for making corrugations thereon.

The device for delivering the forming liquid comprises a liquid source which is supplied under pressure by a pump communicating via a hydraulic intensifier with the inside space of the tubular billet. In this space, the forming liquid flows through an appropriate axial through channel in one of the movable members. The hydraulic intensifier is designed to step up the liquid pressure in the hydraulic drive, said liquid being delivered by a motor-driven liquid pump.

The device for delivering the forming liquid comprises also a pressure regulator connected parallel to the pump and serving to control the pressure of the forming liquid delivered into the tubular billet. After starting the pump, the liquid of the hydraulic drive enters the intensifier after which it flows under a higher pressure into the space of the tubular billet. The air is expelled from the tubular billet through a channel in the clamp. After expulsion of the air this channel is closed by a special valve (see, for example, U.S. Pat. No. 2,654,785).

The prior art apparatus for manufacturing corrugated tubes has a provision for controlling the pressure of the forming liquid delivered into the tubular billet. However, the prior art apparatus has no means for controlling the force of axial compression of the tubular billet in the course of forming corrugations on the tubular billet.

By theoretical research of the process of manufacturing corrugated tubes it has been established that this process requires controlling both the pressure of the forming liquid inside the billet, and the axial compression force.

The joint control of the pressure of the forming liquid delivered into the tubular billet and of the force of axial compression is required for building up a uniaxial stressed state in the material of the tubular billet which, as it has been found, is most advantageous for obtaining the geometrical parameters of the tubes with corrugations ensuring their best operationg qualities such as cyclic strength, durability and stiffness.

It is necessary that changes in the pressure of the forming liquid delivered into the tubular billet are synchronized with the changes in the force of axial compression so that there should be an adequate relationship between these controllable parameters ensuring a uniaxial stressed state.

The prior art apparatus fails to ensure joint control of the pressure of the forming liquid and of the force of axial compression which usually results in an inferior quality of corrugated tubes from the standpoint of the above-mentioned consumer characteristics.

SUMMARY OF THE INVENTION

The main object of the present invention resides in providing an apparatus for manufacturing corrugated tubes whose design would produce corrugated tubes with high operational properties.

Another no less important object of the invention resides in providing an apparatus for manufacturing corrugated tubes of a simple and reliable design with extremely small overall dimensions.

Still another object of the invention resides in providing an apparatus for manufacturing corrugated tubes which would ensure an optimum loading of the tubular billet in the course of forming.

A further object of the invention resides in providing an apparatus for manufacturing corrugated tubes which would produce a minimum amount of waste in making the corrugated tubes.

These and other objects of the invention are achieved by providing an apparatus for manufacturing corrugated tubes comprising a bed which mounts a unit with a hydraulic drive for clamping and sealing the tubular billet, a device for axial compression of the tubular billet communicating with a compressed gas source. Tools are also installed symmetrically relative to the direction of compression with a provision for reciprocating across this direction for encompassing at least partly the tubular billet. The apparatus also incorporats a device with a pressure regulator for delivering pressurized liquid from a liquid source into the tubular billet for forming a corrugated tube. The apparatus further comprises a device for programmed pressure control inside the tubular billet, the inlet of said device being connected to the hydraulic drive of the clamping and sealing unit and its outlet, to the inside space of the tubular billet, and a device for programmed control of axial compression force whose inlet is connected to the compressed gas source and the outlet, to the axial compression device for displacing its movable member, both devices being in operational communication with each other for synchronous changes of axial compression force and pressure inside the tubular billet.

The provision in the apparatus for making corrugated tubes of the device for programmed control of pressure in the tubular billet allows this pressure to be changed within reasonable limits depending on the geometrical parameters and material of the tubular billet.

The provision of the device for programmed control of the axial compression force applied to the tubular billet allows this force to be changed within reasonable limits depending on the geometrical parameters and material of the tubular billet.

The operational communication between the device for programmed pressure control in the tubular billet and the device for programmed control of the axial compression force ensures synchronous changes of these parameters for retaining the required relationship between the controllable parameters in the process of forming corrugations. This ensures the stressed state of the material of the tubular billet which is necessary for obtaining a high quality of the product.

It is expedient that the device for programmed pressure control inside the tubular billet should have a pneumatic cylinder whose spaces are in communication with a compressed gas source and that the movable member of said cylinder should be rigidly coupled with the body of the pressure regulator incorporating a slide valve which forms, together with the regulator body, an inlet space communicating via the hydraulic equipment with the hydraulic drive of the clamping and sealing unit for controlling the displacement of the movable members of the clamping and sealing unit, an outlet space communicating with the space of the tubular billet, and an outlet pressure feedback space communicating with the outlet space. The pressure regulator is provided with a master form mechanically coupled with the other movable member of the clamping and sealing unit and a rod intended for interaction with said master form is connected flexible with the slide valve for transmitting the motion thereto from the master form.

This design of the device for programmed pressure control inside the tubular billet permits the pressure inside the tubular billet to be changed simply and reliably in accordance with the profile of the master form and depending on the displacement of the movable member of the clamping and sealing unit.

It is likewise expedient that the device for programmed control of axial compression force should comprise a pneumatic cylinder and a pneumatic pressure regulator whose body would accommodate a slide valve rigidly connected with the rod of the pneumatic cylinder and forming, together with said body, an inlet space, an outlet space, and a feedback space actuated by the pressure of compressed gas in the axial compression device. The inlet space should communicate with the compressed gas source via a two-position pneumoelectric distributor, the outlet space should be in communication with the discharge space of the pneumatic cylinder and with the axial compression device for displacing its movable member. The operational communication of the device for programmed control of axial compression with the device for programmed control of pressure inside the tubular billet should be ensured by putting the feedback space of the pneumatic pressure regulator in communication with the outlet space of the pressure regulator of the device for programmed pressure control inside the tubular billet.

This layout of the device for programmed control of the axial compression force applied to the tubular billet permits simple and reliable transformation of the pressure of the compressed gas source into a pressure which displaces the movable member of the device for axial compression with a force which depends in a certain way on the pressure changes inside the tubular billet due to the operational communication between the pneumatic pressure regulator and the pressure regulator of the device for programmed pressure control inside the tubular billet.

It is no less expedient that the device for programmed pressure control should be constituted by the pressure regulator of the device for the delivery of pressurized forming liquid, said regulator being provided with an electromagnetic control, having an inlet space which communicates via the hydraulic equipment with the hydraulic drive of the clamping and sealing unit, an outlet space which communicates with the space of the tubular billet, an electrical control circuit of the regulator and a feedback circuit actuated by pressure inside the tubular billet.

This design of the device for programmed pressure control makes it possible to dispense with the master form for controlling the displacement of the movable member of the pressure regulator which will reduce considerably the overall size of the apparatus.

In this case, it is expedient that the electrical control circuit should comprise an input signal setter and a summing amplifier whose input would be connected to the output of the input signal setter and whose outputs would be connected to the electromagnets of the pressure regulator, and the feedback circuit would comprise an electrohydraulic pressure transmitter whose input is connected with the space of the tubular billet and the output is connected across an amplifier with the summing amplifier.

This permits controlling the pressure by the outside input signal setter which may be constituted by a computer. The use of an outside setter and miniature electronic elements in the electrical control circuit is beneficial when there is a need for reducing the size of the apparatus.

It is also expedient that the device for programmed control of axial compression force should comprise an electromagnetically controlled pneumatic pressure regulator having an inlet space communicating with a source of compressed gas through a two-position pneumoelectric distributor, and an outlet space communicating with the axial compression device, also a feedback circuit actuated by the compressed gas pressure in the axial compression device.

This design of the device for programmed control of axial compression force permits a reduction of the apparatus dimensions due to simplification of the design of the pneumatic pressure regulator.

Besides, electromagnetic control ensures a greater regulator controlling force than does pneumatic control which rules out almost completely any failures in the functioning of the pneumatic pressure regulator which often does not have enough lubricant as compared with the hydraulic regulators.

In this case, it is expedient that the electrical control circuit of the device for programmed control of axial compression force should be constituted by a feedback circuit of the device for programmed control of pressure inside the tubular billet and by an additional summing amplifier connected to this circuit, while the feedback circuit of the device for programmed control of axial compression force should incorporate an electropneumatic transmitter whose input is connected with the axial compression device for displacing its movable member and whose output is connected across an additional amplifier to an additional summing amplifier.

This makes it possible to additionally reduce the overall dimensions of the apparatus because the already available circuit of the device for programmed control of pressure inside the tubular billet consisting, mainly, of miniature electronic elements is used in the capacity of the electrical control circuit of the device for programmed control of axial compression force.

Thus, the apparatus for manufacturing corrugated tubes in accordance with the present invention ensures the manufacture of corrugated tubes with higher operational characteristics by ensuring optimum stresses in the material of the tubular billet in the course of forming the corrugations.

The apparatus of the invention has a rather simple and reliable design and is of small dimensions.

BRIEF DESCRIPTION OF THE DRAWINGS

Now the invention will be described in detail by way of examples with reference to the accompanying drawings in which.

DESCRIPTION OF THE PREFERRED EMBODIMENTS

Figure 1:
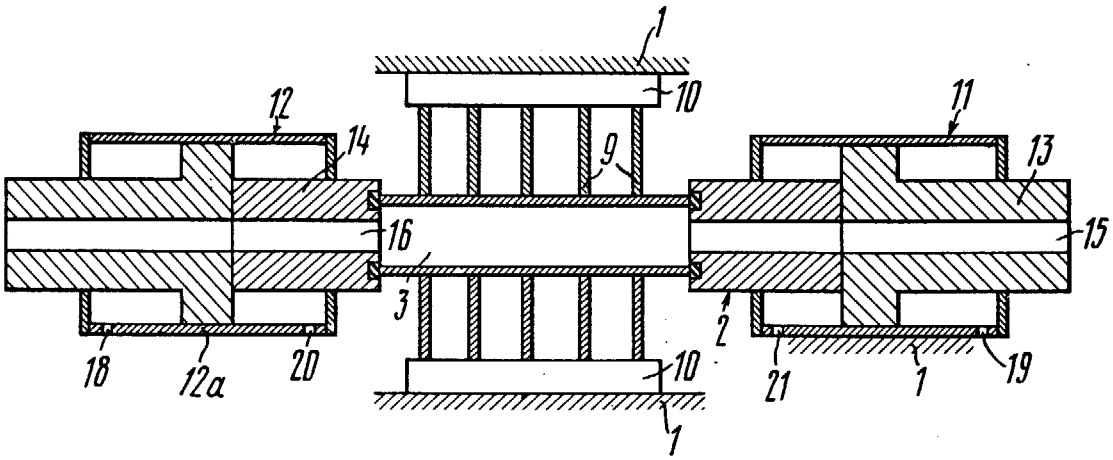
FIG. 1 is a schematic, longitudinal section of the apparatus for manufacturing corrugated tubes in accordance with the invention wherein the hydraulic, pneumatic and electrical systems are omitted for the sake of clarity.

The apparatus for manufacturing corrugated tubes according to the present invention comprises a bed 1 (FIG. 1) which mounts a unit 2 with a hydraulic drive 4 (FIG. 2) for clamping and sealing the tubular billet 3.

The apparatus also has a device 5 for axial compression of the tubular billet 3, said device also being mounted on the bed 1 and communicating with a compressed gas source 6 through a line 7 for displacing the movable member 8 of the device 5.

Tools 9 (FIG. 1) are installed in holders 10 symmetrically to the direction of compression, i.e. relative to the longitudinal axis of the tubular billet 3. The holders 10 are installed on the bed 1 with a provision for being reciprocated across this direction by a drive (not shown) of any known design suitable for the purpose for partial encompassing of the tubular billet 3 by the tools 9 in the course of forming.

The tools 9 are, in this case, rings designated by the same number 9 and encompassing the tubular billet 3 by their internal surface. The rings 9 are equispaced along the axis of the tubular billet 3. The number of the rings 9 depends on the number of corrugations on the finished product.

Each ring 9 consists of two-half-rings which can be moved relative to each other by the holders 10 actuated by a drive.

In other cases the shape of the tools 9 can be correspondingly changed.

The unit 2 for clamping and sealing the tubular billet 3 comprises hydraulic cylinders 11 and 12 with movable members 13 and 14 which have through axial channels 15 and 16.

The body of the hydraulic cylinder 11 is rigidly fixed on the bed 1 while the body 12*a* which is the other movable member of the hydraulic cylinder is installed on the bed 1 with a provision for being reciprocated by the device 5 for axial compression of the tubular billet 3 in order to maintain constant contact between the ends of the movable members 13 and 14 and the ends of the tubular billet 3 in the course of corrugation forming during which the length of the tubular billet diminishes.

The body 12*a* of the hydraulic cylinder 12 is provided with a lever 17 (FIG. 2) for moving the hydraulic cylinder 12 by the device 5 for axial compression of the tubular billet 3.

Each of the hydraulic cylinder bodies 11, 12 has two ports 18, 20 and 19, 21 (FIG. 1) for putting the spaces of the hydraulic cylinders 11, 12 in communication with the hydraulic drive 4. This communication is necessary for displacing the movable members 13, 14 of the hydraulic cylinders 11, 12 in order to clamp and seal the tubular billet 3.

The hydraulic drive 4 (FIG. 2) of the unit 2 for clamping and sealing the tubular billet 3 is designed to deliver pressurized liquid into the lines 22, 23. The hydraulic drive is of any known design suitable for the purpose and is not described here so as not to obscure the essence of the invention. The hydraulic drive 4 communicates with the spaces of the hydraulic cylinders 11, 12 through the hydraulic equipment 24. The hydraulic equipment 24 (FIG. 2) is intended to communicate the hydraulic drive 4 with the spaces of the hydraulic cylinders 11, 12 (FIG. 1) through a line 25 (FIG. 2) or line 26 for displacing the movable members 13, 14 of the hydraulic cylinders 11, 12. The hydraulic equipment 24 may be of any conventional design suitable for the purpose.

The device 27 for delivering the forming liquid under pressure comprises a forming liquid source 28, a pressure regulator 29 and a liquid divider 30 (hydraulic drive liquid-forming liquid) and is intended to deliver the forming liquid under controllable pressure into the space of the tubular billet 3. The pressure regulator 29 (FIG. 2) whose design will be dealt with in detail hereinbelow is connected through the hydraulic equipment 31 with the hydraulic drive 4 and connected with the space of the tubular billet 3 through the liquid divider 30 (hydraulic drive liquid-forming liquid) which is called upon to eliminate contact between these heterogeneous liquids and thus to avoid their mixing. The divider may also have any design suitable for the purpose. The forming liquid space of the liquid divider 30 communicates with the forming liquid source 28 through a pump 32 intended to make up for the losses of the forming liquid usually caused by the wettability of the tubular billet 3. The forming liquid space of the liquid divider 30 also communicates with the space of the tubular billet 3 through an axial through channel 15 in the movable member 13 for delivering the forming liquid under pressure into the tubular billet 3. The through axial channel 16 in the movable member 14 serves for letting out air from the space of the tubular billet 3 through the cut-off valve 33 into the forming liquid source 28.

The apparatus is also provided with a device 34 for programmed control of pressure in the space of the tubular billet 3 whose input is connected to the hydraulic drive 4 of the clamping and sealing unit 2 and whose output is connected to the space of the tubular billet 3 through said liquid divider 30.

The apparatus also has a device 35 for programmed control of axial compression force whose input is connected to the compressed gas source 6 while the output is connected to the axial compression device 5 for displacing its movable member 8. The device 34 for programmed pressure control inside the tubular billet 3 and the device 35 for programmed control of the axial compression force are interconnected operationally by the communication line 34*a*.

The device 34 for programmed pressure control in the space of the tubular billet 3 has a pneumatic cylinder 36 ridigly fixed on the bed 1 and having a movable member 37. The spaces 36*a*, 36*b* of the pneumatic cylinder 36 communicate with each other through controllable flow restrictors 38, 39 and distributor 40 with the compressed gas source 6.

The distributor 40 is intended to communicate one of the spaces 36*a*, 36*b* of the pneumatic cylinder 36 with the compressed gas source 6 or to isolate said spaces 36*a*, 36*b* from the compressed gas source 6 and can be of any design suitable for the purpose.

The controllable flow restrictors 38, 39 are intended to control the speed of displacement of the movable member 37 of the pneumatic cylinder 36 and may be of any design suitable for the purpose.

The movable member 37 of the pneumatic cylinder 36 is connected rigidly with the body of the pressure regulator 29 by the lever 41 for moving said body of said regulator by the movable member 37 of the pneumatic cylinder 36.

The body of the pressure regulator 29 accomodates a slide valve 42 forming in said body an inlet space 43 communicating through the hydraulic equipment 31 and line 22 with the hydraulic drive 4 of the clamping and sealing unit 2, an outlet space 44 communicating with the space of the tubular billet 3, and an outlet pressure feedback space 44*a* communicating with the outlet space 44.

The pressure regulator 29 comprises a master form 45 mechanically coupled with the other movable member 12*a* of the clamping and sealing unit 2. The master form 45 is intended to move the slide valve 42 of the pressure regulator 29 in accordance with a preset program governed by the movement of the other movable member 12*a* and has a profiled surface whose shape obeys the law of pressure changes in the space of the tubular billet 3 in the course of forming a corrugated tube. The programmed movement of the slide valve 42 is transmitted from the master form by the rod 46 via a flexible element 46*a*.

The device 35 for programmed control of axial compression force consists of a pneumatic cylinder 47 and a pneumatic pressure regulator 48 whose body accommodates a slide valve 49.

The slide valve 49 is rigidly connected with the rod of the pneumatic cylinder 47 and forms in the body of the regulator 48 an inlet space 50, an outlet space 51 and a feedback space 52 actuated by the pressure of compressed gas in the axial compression device 5.

The inlet space 50 communicates with the compressed gas source 6 through a two-position pneumoelectric distributor 53 connected to a current supply (not shown).

The two-position pneumoelectric distributor 53 is designed to connect or disconnect the compressed gas source 6 and the pneumatic pressure regulator 48 and can have any design suitable for the purpose.

The outlet space 51 of the pneumatic pressure regulator 48 communicates with the discharge space 47*a* of the pneumatic cylinder 47 and with the axial compression device 5.

The operational communication 35*a* of the device 35 for programmed control of axial compression force with the device 34 for programmed pressure control in the space of the tubular billet 3 is effected in this modification of the invention by putting the feedback space 52 of the pneumatic pressure regulator 48 in communication with the outlet space 44 of the pressure regulator 29 through a pipeline designated by the same number 35*a*.

In another modification of the invention, the deivce 34 for programmed pressure control is constituted by the abovementioned pressure regulator of the device 27 for delivering the forming liquid under pressure, said regulator being designated in this modification by the reference numeral 54 (FIG. 3); its design is described below and it is electromagnetically controlled by electromagnets 55, 56.

The electromagnets 55, 56 control the movement of the slide valve 57 of the pressure regulator 54 and may have any design suitable for the purpose. Together with the body of the pressure regulator 54 the slide valve 57 forms an inlet space 58 which communicates through the hydraulic equipment 31 described above with the hydraulic drive 4 of the clamping and sealing unit 2 of the tubular billet 3, and an outlet space 59 communicating with the space of the tubular billet 3 through the liquid divider 30 (hydraulic drive liquid-forming liquid).

The pressure regulator 54 has a circuit 60 controlling the movement of the slide valve 57 of the pressure regulator 54 intended to control the electromagnets 55, 56 which move the slide valve 57, and a feedback circuit 61 actuated by pressure inside the tubulr billet 3 and intended to ensure correspondence of the true pressure in the tubular billet 3 to the preset pressure.

The electrical control circuit 60 comprises an input signal setter 62 and a summing amplifier 63. The input signal setter 62 sets the signal in the electrical control circuit 60 which is proportional to the required current pressure inside the tubular billet 3 and may be of any known design suitable for the purpose.

The summing amplifier 63 is designed to compare the current value of the signal sent by the input signal setter 62 with the signal proportional to the current true value of pressure inside the tubular billet 3 (feedback signal) and thus to generate an amplified control signal for controlling the electromagnets 55, 56. The summing amplifier 63 may be of any known design suitable for the purpose.

The input of the summing amplifier 63 is connected to the output of the input signal setter 62 and the output is connected to the electromagnets 55, 56 of the pressure regulator 54.

The feedback circuit 61 comprises an electrohydraulic pressure transmitter 64 and an amplifier 65, both connected to a current supply. The electrohydraulic transmitter transforms pressure in the space of the tubular billet 3 into an electric signal proportional to this pressure and can be of any known design suitable for the purpose.

The amplifier 65 amplifies the signal of the electrohydraulic transmitter 64 and can be of any design ensuring the performance of this function.

The input of the electrohydraulic transmitter 64 communicates with the space of the tubular billet 3 while its output is connected across the amplifier 65 to the summing amplifier 63.

In the modification of the invention described herein, the device 35 for programmed control of the axial compression force comprises a pneumatic pressure regulator 66 with electromagnetically controlled movement of the slide valve 67 of the pressure regulator 66 with the aid of electromagnets 68, 69. The function of the electromagnets 68,69 is similar to that of the electromagnets 55, 56 of the pressure regulator 54.

The slide valve 67 together with the body of the pneumatic pressure regulator 66 forms an inlet space 70 communicating with the compressed gas source 6 through the two-position pneumoelectric distributor 53, and an outlet space 71 communicating with the axial compression device 5.

The device 35 for programmed control of axial compression force also comprises a circuit 72 for electric control of the movement of the slide valve 67 of the pneumatic pressure regulator 66 for generating and transmitting control signals to the electromagnets 68, 69, and a feedback circuit 73 actuated by the compressed gas pressure in the axial compression device 5, serving to ensure the correspondence of the acting compression force to the preset value.

The electrical control circuit 72 of the device 35 for programmed control of axial compression force is a feedback circuit 61 actuated by the pressure inside the tubular billet 3 of the device 34 for programmed pressure control inside the tubular billet 3 and an additional summing amplifier 74 connected to this circuit 61. The purpose of the additional summing amplifier 74 is similar to that of the summing amplifier 63.

The feedback circuit 73 actuated by the compressed gas pressure in the axial compression device 5 consists of an electropneumatic transmitter 75 and an additional amplifier, both connected to a current supply.

The electropneumatic transmitter 75 transforms compressed gas pressure into an electric signal proportional to this pressure and can be of any known design suitable for the purpose. The purpose of the additional amplifier 76 is similar to that of the amplifier 65.

The input of the electrompneumatic transmitter 75 is communicated with the axial compression device 5 and its output is connected across an additional amplifier 76 to the additional summing amplifier 74.

The apparatus also comprises a pan 77 for collecting the forming liquid dripping down from the removed finished article. The pan 77 is in communication with the forming liquid source 28 for returning the liquid collected in the pan 77.

Figure 2:
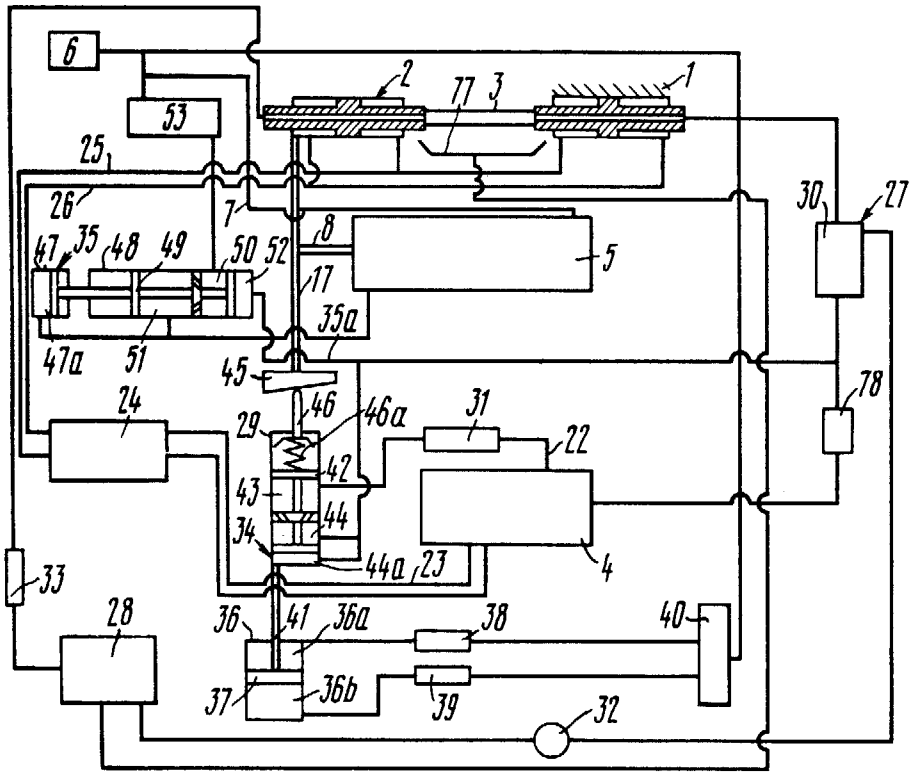
FIG. 2 illustrates the electro-diagram of the apparatus for manufacturing corrugated tubes according to the invention.

In the modification of the invention illustrated in FIG. 2, the hydraulic drive 4 of the clamping and sealing unit 2 communicates with the forming liquid delivery device 27 through a hydraulic cut-off valve 76 for filling the tubular billet 3 with forming liquid past the pressure regulator 29.

The apparatus for making corrugated tubes as shown in FIG. 2 functions as follows.

The tubular billet 3 is clamped between the rings 9 which, together with the holders 10, are moved by the drive perpendicularly to the axis of compression of the tubular billet 3 and encompass the billet.

Then the control system (not shown) turns on the hydraulic equipment 24 in such a way that the hydraulic drive 4 of the clamping and sealing unit 2 ensures the delivery of liquid under pressure through the lines 23,26 into the corresponding spaces of the hydraulic cylinders 11, 12 through ports 18, 19, thus pressing the movable members 13, 14 against the ends of the tubular billet 3 and sealing the latter hermetically from ambient air.

The liquid of the hydraulic drive 4 is delivered through the opened hydraulic cut-off valve 78 into the liquid divider 30 (dividing the hydraulic drive liquid from the forming liquid) and is fed therefrom through an axial through channel 15 into the tubular billet 3. The air is expelled from the tubular billet 3 through the axial through channel 16 and the open cut-off valve 33 into the forming liquid source 28.

After the air has been completely expelled from the tubular billet 3, the cut-off valve 33 closes, the hydraulic cut-off valve 78 closes too, the hydraulic equipment 31 is set to the position ensuring communication of the hydraulic drive 4 with the inside space of the tubular billet 3 through the device 34 for programmed pressure control inside the tubular billet 3.

Simultaneously, the distributor 40 is set to a position ensuring the communication of the compressed gas source 6 with the space 36*a* of the pneumatic cylinder 36. The movable member 37 of the pneumatic cylinder 36 moves at a speed determined by the setting of the controllable flow restrictors 38, 39 and moves the body of the pressure regulator 29. Owing to gradual compression of the flexible element 47 the degree of throttling of the hydraulic drive liquid between the inlet space 43 and outlet space 44 diminishes which results in a gradual increase of pressure inside the tubular billet 3.

After a certain pressure has been reached inside the tubular billet 3, the two-position pneumoelectric distributor 53 communicates the axial compression device 5 with the compressed gas source 6 through the device 35 for programmed control of axial compression force.

Simultaneously, the distributor 40 puts the spaces 36*a*, 36*b* of the pneumatic cylinder 36 in communication with the ambient air.

The movable member 8 and lever 17 of the axial compression device 5 move the other movable member 12*a* of the hydraulic cylinder 12 of the clamping and sealing unit 2, thereby compressing axially the tubular billet 3 with a force determined by the setting of the pneumatic pressure regulator 48.

At the same time the movable member 8 of the axial compression device 5 moves the master form 45 which is mechanically linked therewith. The moving master form 45 displaces the rod 46 of the pressure regulator 29 and the flexibly connected slide valve 42, thus changing pressure inside the tubular billet 3 in accordance with the law set by the profile of the master form 45.

The feedback space 44*a* actuated by the outlet pressure rules out the mismatching between the pressure set by the master form 45 and the true pressure inside the tubular billet 3.

The synchronism of the pressure changes with the changes in the axial compression of the tubular billet 3 is ensured by the feedback 35*a* which is in this case constituted by a pipeline designated by the same number 35*a*; this pipeline delivers the liquid of the hydraulic drive 4 from the outlet space 44 of the pressure regulator 29 into the feedback space 52 of the pneumatic pressure regulator 48.

This pressure is compared with the pressure in the outlet space 51 of said pressure regulator 48 and, if the outlet pressure of compressed gas differs from the programmed value determined by the hydraulic drive liquid pressure in the outlet space 44 of the pressure regulator 29, the slide valve 49 of the pneumatic pressure regulator 48 moves, changing the value of flow restriction of compressed gas between the inlet space 50 and outlet space 51, correspondingly changing the pressure of compressed gas entering the axial compression device 5 which latter changes correspondingly the force of axial compression of the tubular billet 3.

After the corrugated tube has been finally formed, the two-position pneumoeletric distributor 53 disconnects the compressed gas source 6 from the device 35 for programmed control of axial compression force, the hydraulic equipment 31 is brought to a position in which it disconnects the hydraulic drive 4 from the device 34 of programmed pressure control inside the tubular billet 3. Then the distributor 40 ensures communication of the compressed gas source 6 with the space 36*b* of the pneumatic cylinder 36, displacing the movable member 37 and the body of the pressure regulator 29 to the initial position.

The axial compression device 5 brings the other movable member 12*a* of the hydraulic cylinder 12 to the initial position while the hydraulic equipment 24 is brought to a state in which the liquid under pressure is delivered from the hydraulic drive 4 through lines 23, 25 and ports 20, 21 into the corresponding spaces of the hydraulic cylinders 11, 12 of the clamping and sealing unit 2, thereby shifting the movable members 13, 14 to the initial position.

The forming liquid flowing from inside the finished product drips down into the pan 77 wherefrom it flows into the forming liquid source 28.

The losses of the forming liquid are made up for when required by the pump 32 feeding said liquid from the source 28 into the forming liquid space of the liquid divider 30 which divides the hydraulic drive liquid from the forming liquid.

Figure 3:
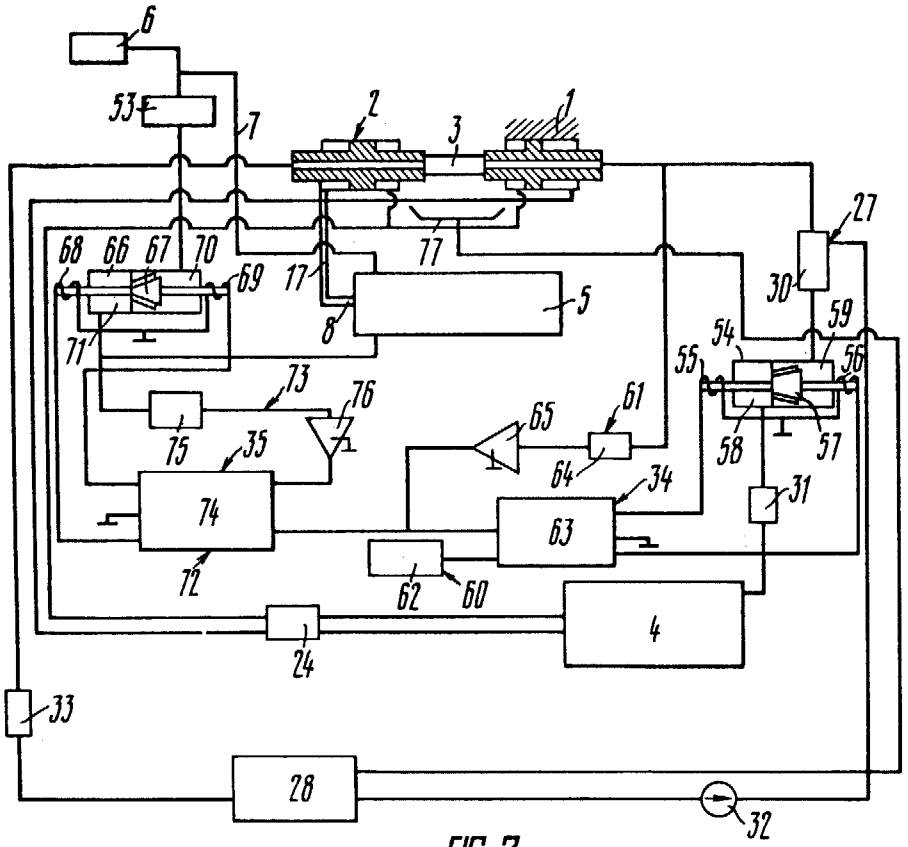
FIG. 3 illustrates the electropneumohydraulic diagram of another version of the apparatus for manufacturing corrugated tubes according to the invention, also scaled down.

The pneumatic and hydraulic systems of the disclosed apparatus for manufacturing corrugated tubes in the modification illustrated in FIG. 3 function similarly to the abovedescribed operation of the apparatus in the modification illustrated in FIG. 2.

Therefore, the following discussion will deal only with the operational peculiarities of the apparatus caused by the features of design illustrated in FIG. 3.

The electronic control system (not shown), e.g. a computer, sets the law of pressure changes in the space of the tubular billet 3 by the input signal setter 62 which is represented in this particular case by an electric signal proportional in magnitude to the value of the required pressure in the tubular billet 3 at the given moment.

The input signal is fed into the input of the summing amplifier 63 and thence to the electromagnets 55, 56 of the pressure regulator 54. In accordance with the signal on these electromagnets the slide valve 57 moves along its axis, changing the throttling of the liquid of the hydraulic drive 4 between the inlet space 58 and the outlet space 59 of the pressure regulator 54 and thereby changing the pressure inside the tubular billet 3.

The feedback circuit 61 supplies the summing amplifier 63 with a signal proportional to the current value of the pressure inside the tubular billet 3; said pressure is transformed by the eletrohydraulic transmitter 64 into an electric signal which is proportional to this pressure and is amplified by the amplifier 65.

If the signal of the feedback circuit 61 differs from the signal sent from the input signal setter 62, there appears a mismatching signal which is amplified in the summing amplifier 63 and fed into one of the electromagnents 55, 56. As a result, the throttling of the liquid between the inlet space 58 and outlet space 59 decreases or increases until the system comes to an equilibrium, i.e. until the signal of the feedback circuit 61 becomes precisely equal to the input signal.

Thus, the device 34 for programmed pressure control ensures an optimum pressure inside the tubular billet 3 as governed by the input signal of the setter 62.

The programmed control of the axial compression force applied to the tubular billet 3 is effected by the pneumatic pressure regulator 66 which sends control signals to the electromagnets 68, 69 from the additional summing amplifier 74. The input signal of the additional summing amplifier 74 is constituted by the signal of the feedback circuit 61 of the programmed pressure control device 34 because the proportional changes in the axial compression force must take place in accordance with the true pressure inside the tubular billet 3.

The feedback coupling actuated by pressure in the axial compression 5 is effected by the electropneumatic transmitter 75 which transforms the compressed gas pressure into an electric signal proportional to the true pressure in the axial compression device 5. The signal sent by the electropneumatic transmitter 75 is amplifed by the additional amplifier 76 and is fed to the input of the additional summing amplifier 74.

If the signal of the electropneumatic transmitter 75 differs from the present signal (feedback 61 signal), the mismatching signal produced by the additional summing amplifier 74 is delivered to one of the electromagnets 68, 69 until the true pressure in the axial compression device 5 becomes equal to that which corresponds to the input signal, i.e. until the mismatching signal vanishes.

A pilot apparatus for manufacturing corrugated tubes realized in accordance with the present invention has successfully passed tests which have proved that the service life of the corrugated tubes made on said apparatus, (measuring bellows) has been extended by 20–30%.

The disclosed apparatus for manufacturing corrugated tubes improves the quality of the finished products and reduces waste to 1–2%.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

We claim:

1. An apparatus for manufacturing corrugated tubes from a tubular billet comprising: a bed; a unit for clamping and sealing a tubular billet installed on said bed; a hydraulic drive of said clamping and sealing unit installed on said bed; a liquid source of said hydraulic drive; a compressed gas source; a device for axial compression of the tubular billet communicating with said compressed gas source and installed on said bed; a source of forming liquid; a device for delivering pressurized liquid from said liquid source into the tubular billet for forming the corrugated tube installed on said bed; a pressure regulator of said forming liquid delivery device; tools installed on said bed symmetrically with relation to the direction of compression of the tubular billet with a provision for reciprocating across said direction of compression for at least partial encompassing of the tubular billet; a drive for reciprocating said tools; a device for programmed pressure control inside the tubular billet, connected by its input to said hydraulic drive and by the output, to the space of the tubular billet; a device for programmed control of axial compression force connected by its input to said compressed gas source and by the output, to said axial compression device for displacing the movable member thereof; said device for programmed pressure control inside the tubular billet and said device programmed control of axial compression force interconnected operationally for synchronous changes of the axial compression force and of pressure inside the tubular billet.

2. An apparatus according to claim 1, wherein said device for programmed pressure control inside the tubular billet incorporated a pneumatic cylinder whose spaces communicate with said compressed gas source and whose movable member is rigidly connected with the body of said pressure regulator which has a slide valve forming, together with the body of said pressure regulator, an inlet space communicating through the hyraulic equipment with said hydraulic drive of said clamping and sealing unit for controlling the displacement of the movable members of said clamping and sealing unit, an outlet space communicating with the space of the tubular billet, and a feedback space actuated by the outlet pressure and communicating with the outlet space, said pressure regulator having a master form mechanically coupled with the other movable member of said clamping and sealing unit, and a rod which is intended to interact with said master form and is connected flexibly with the slide valve for transmitting motion thereto from the master form.

3. An apparatus according to claim 2, wherein said device for programmed control of axial compression force comprises a pneumatic cylinder and a pneumatic pressure regulator whose body accommodates a slide valve rigidly connected with the rod of the pneumatic cylinder and forming, together with the body, inlet and outlet spaces and a feedback space actuated by the compressed gas pressure in said axial compression device, said inlet space communicating with said compressed gas source through a two-position pneumoelectric distributor, said outlet space communicating with the discharge space of the pneumatic cylinder and with said axial compression device for displacing its movable member, the operational connection of said device for programmed control of axial compression force with said device for programmed pressure control inside the tubular billet being effected by putting the feedback space of the pneumatic pressure regulator in communication with the outlet space of said pressure regulator of said device for programmed pressure control inside the tubular billet.

4. An apparatus for manufacturing corrugated tubes from a tubular billet comprising a bed; a unit for clamping and sealing a tubular billet, installed on said bed; a hydraulic drive of said clamping and sealing unit installed on said bed; a liquid source of said hydraulic drive; a compressed gas source; a device for axial compression of the tubular billet, communicating with said compressed gas source and mounted on said bed; a source of forming liquid; a current source; a device for delivering the liquid under pressure from said liquid source into the tubular billet for forming the corrugated tube installed on said bed; a pressure regulator of said device for delivering the forming liquid; tools installed on said bed symmetrically relative to the direction of compression of the tubular billet with a provision for reciprocating across said direction for at least partial encompassing of the tubular billet; a drive for reciprocating said tools; a device for programmed pressure control inside the tubular billet, connected by its input to said hydraulic drive and by the output, to the space of the tubular billet; a device for programmed control of axial compression force connected by its input to said compression gas source and by the output, to said axial compression device for displacing the movable member thereof; said device for programmed pressure control inside the tubular billet and said device for programmed control of the axial compression force, operationally interconnected for synchronous changes of the axial compression force and pressure inside the tubular billet; said device for programmed pressure control inside the tubular billet, constituted by said pressure regulator which is provided with electromagnetic control, has an inlet space communicating through the hydraulic equipment with said hydraulic drive, an outlet space communicating with the space of the tubular billet, and an electrical control circuit for controlling said regulator and a feedback circuit actuated by pressure inside the tubular billet.

5. An apparatus according to claim 4, wherein the electrical control circuit comprises an input signal setter and a summing amplifier whose input is connected to the output of the input signal setter while its outputs are connected to the electromagnets of said pressure regulator, and the feedback circuit comprises an electrohydraulic pressure transmitter whose inlet communicates with the space of the tubular billet while its outlet is connected via an amplifier to the summing amplifier.

6. An apparatus according to claim 4, wherein said device for programmed control of the axial compression force comprises a pneumatic pressure regulator with electromagnetic control, said regulator having an inlet space communicating with said compressed gas source through a two-position pneumoelectric distributor, and an outlet space communicating with said axial compression device, and an electrical control circuit controlling the pneumatic pressure regulator and a feedback circuit actuated by the compressed gas pressure in said axial compression device.

7. An apparatus according to claim 6, wherein the electrical control circuit of said device for programmed control of axial compression force is constituted by a feedback circuit of said device for programmed pressure control inside the tubular billet and an additional summing amplifier connected to said circuit, while the feedback circuit of said device for programmed control of axial compression force comprises an electrohydraulic transmitter whose input communicates with said axial compression device for displacing the movable member thereof, and whose input is connected across an additional amplifier to the additional summing amplifier.

* * * * *